US006253833B1

(12) United States Patent
Köster et al.

(10) Patent No.: US 6,253,833 B1
(45) Date of Patent: Jul. 3, 2001

(54) HEATING SHEET BUNDLE FOR REGENERATIVE HEAT EXCHANGERS

(75) Inventors: Gerd Köster, Reichshof-Odenspiel; Winfried Moll, Freudenberg; Siegfried Schlüter, Wenden-Rothemühle, all of (DE)

(73) Assignee: Apparatebau Rothemühle Brandt & Kritzler GmbH, Wenden (DE)

( * ) Notice: Subject to any disclaimer, the term of this patent is extended or adjusted under 35 U.S.C. 154(b) by 548 days.

(21) Appl. No.: 08/691,988

(22) Filed: Aug. 2, 1996

(30) Foreign Application Priority Data

Aug. 4, 1995 (DE) ..... 195 28 634

(51) Int. Cl.[7] ..... F28D 17/00
(52) U.S. Cl. ..... 165/10; 165/8; 165/4
(58) Field of Search ..... 165/10, 8, 6, 4

(56) References Cited

U.S. PATENT DOCUMENTS

| | | | | |
|---|---|---|---|---|
| 3,379,240 | * | 4/1968 | Woolard et al. | 165/10 |
| 3,532,157 | * | 10/1970 | Hubble | 165/8 |
| 3,605,874 | * | 9/1971 | Brunell | 165/10 X |
| 3,901,309 | * | 8/1975 | Thebert | 165/8 |
| 3,996,997 | * | 12/1976 | Regan et al. | 165/8 |
| 4,061,183 | * | 12/1977 | Davis | 165/8 |
| 4,182,402 | * | 1/1980 | Adrian | 165/10 |
| 4,255,171 | | 3/1981 | Dravnieks . | |
| 4,405,011 | * | 9/1983 | Stockman | 165/10 |
| 4,739,822 | * | 4/1988 | Mergler | 165/8 X |
| 4,838,342 | * | 6/1989 | Goetschius | 165/8 X |
| 4,984,621 | * | 1/1991 | Miller et al. | 165/8 X |

FOREIGN PATENT DOCUMENTS

| | | | | |
|---|---|---|---|---|
| 3011210 | | 10/1981 | (DE) . | |
| 2403534 | | 4/1979 | (FR) . | |
| 1401622 | * | 7/1975 | (GB) | 165/8 |
| 1439674 | | 6/1976 | (GB) . | |
| 2272507 | | 5/1994 | (GB) . | |

* cited by examiner

*Primary Examiner*—Christopher Atkinson
(74) *Attorney, Agent, or Firm*—Friedrich Kueffner

(57) ABSTRACT

A heating sheet bundle to be mounted tangentially or radially in trapezoidally segmented cells of heating surface carriers of regenerative heat exchangers with stationary or revolving storage masses is composed of a plurality of profiled sheets which are stacked on top of each other and are held together so as to form passage ducts therebetween. On at least two oppositely located sides of the bundle, at least the two outer profiled sheets are constructed as a pair of sheets connected in a dimensionally stable, sandwich-like manner. One of the profiled sheets of the pair of profiled sheets is undulated and the other of the profiled sheets of the pair of profiled sheets is corrugated, wherein the rolling depth of the undulated sheet is greater than the rolling depth of the corrugated sheet.

4 Claims, 3 Drawing Sheets

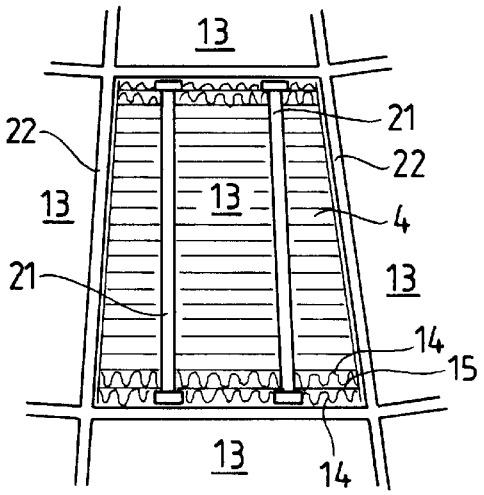
FIG.5
FIG.6
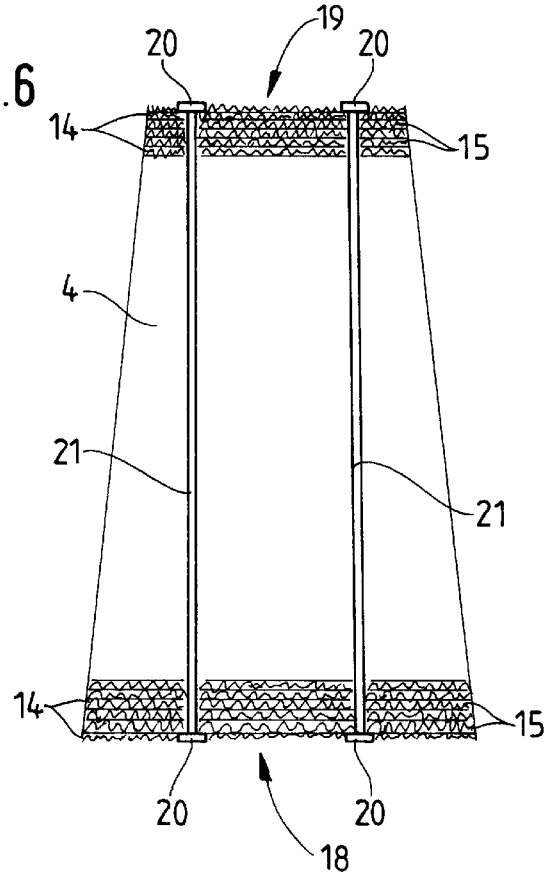
FIG.7
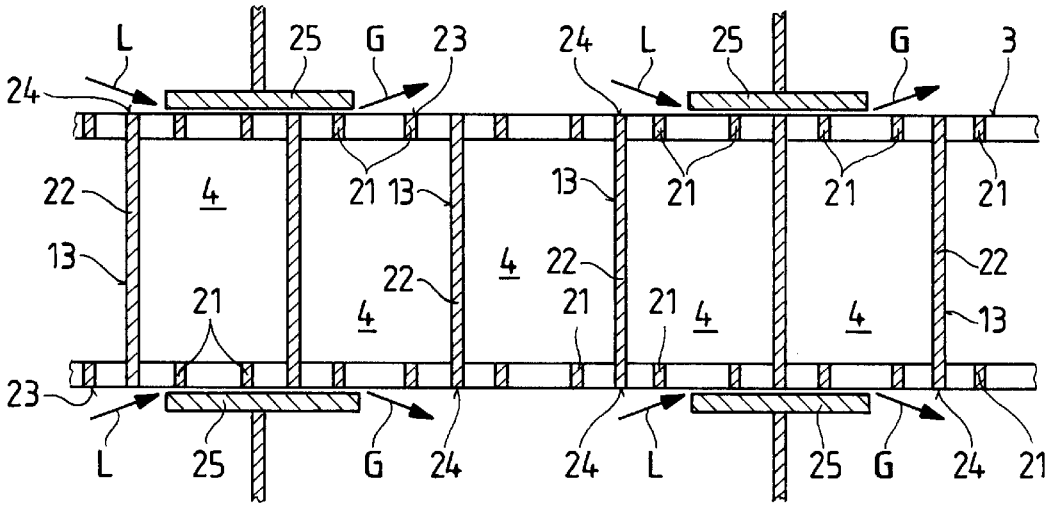

HEATING SHEET BUNDLE FOR REGENERATIVE HEAT EXCHANGERS

BACKGROUND OF THE INVENTION

1. Field of the Invention

The present invention relates to a heating sheet bundle to be mounted tangentially or radially in trapezoidally segmented cells of heating surface carriers of regenerative heat exchangers with stationary or revolving storage masses. The sheet bundle is composed of a plurality of profiled sheets which are stacked on top of each other and are held together so as to form passage ducts therebetween.

2. Description of the Related Art

The regenerative heat exchanger can be used for the preheating of air as well as for the preheating of gas. When used as an air preheater, the regenerative heat exchanger is used for preheating the combustion air in power plant furnaces and industrial furnaces, and, when used as a gas preheater, the regenerative heat exchanger is used for preheating in waste gas purification, for example, in catalytically operating reactors, or for reheating in a gas washing plant. The heat exchange between the hot gas which flows off and the air supplied in a counter-current flow to the gas is achieved either by a rotating heating surface carrier or, when the heating surface carrier is stationary, by hoods which are arranged on both sides of the storage masses and continuously rotate about a common axis.

The heating surfaces or storage masses of such regenerative heat exchangers are composed of two differently profiled steel sheets which have a thickness, for example, of 0.5–1.3 mm and may be coated or enamelled. Corresponding to the cell-like construction of the circular heating surface carrier, the steel sheets are bundled and are placed with fit in the individual cells of the heating surface carrier. The heating sheets are bundled by means of massive boxes or frame supports which are placed around the bundled heating sheets. When the heating sheets are arranged tangentially, which is usually the case because of the more stable placement of the bundle, it is conventional to hold the heating sheet bundle together by means of head plates at their head ends which are parallel as related to the trapezoidal shape, wherein the head plates are connected to each other at the upper and lower sides through horizontally extending rods each. The heating sheet bundles are arranged in accordance with the gas flow direction, i.e., they are usually arranged vertically.

In this manner of constructing the heating sheet bundles which has been known for a long time, the massive support means not only increase the weight of the bundle, but they additionally use up a significant portion of the available assembly space; this is equally true for sheet layers of the heating sheet bundle arranged tangentially or radially. Consequently, it is unavoidable that the free flow cross section for the passage of air or gas is reduced.

SUMMARY OF THE INVENTION

Therefore, it is the primary object of the present invention to simplify a heating sheet bundle of the above described type. In particular, it should be possible to mount the bundle in a manner which has less weight and an improved flow through the bundle is to be achieved.

In accordance with the present invention, on at least two oppositely located sides of the bundle, at least the two outer profiled sheets are constructed as a pair of sheets connected in a dimensionally stable, sandwich-like manner.

When mounting a heating sheet bundle with tangentially aligned profiled sheets, the two outer profiled sheets are the two end sides which extend parallel to each other, and when mounting a heating sheet bundle with radially aligned profiled sheets relative to the heating surface carrier, the longitudinal sides of the bundle extending in a diverging manner in accordance with the trapezoidal shape of the heating surface carrier cells are constructed with a pair of profiled sheets in accordance with the present invention. Consequently, the heating sheet bundles no longer require heavy end plates or even a complete surrounding housing; rather, the pair of outer profiled sheets which essentially form a hollow box carrier ensure a sufficient stability; the stability is further improved by the fact that vertical outer rods of the profiled sheets are connected to horizontal rods at the upper and lower side of the bundle, so that a strap-like bracing of the heating surface bundle is achieved.

The sandwich-like connection in the manner of a hollow box carrier of at least the two outer profiled sheets of the heating sheet bundle produces, in addition to reducing the weight, especially a better utilization of the available assembly volume in the heating surface carrier and, thus, an increase of the active heating surface area. This is because, contrary to the conventional end plate arrangements or circumferential frames, the profiled sheets of the pairs of profiled sheets are capable without restriction of being utilized, in the same manner as all other heating sheets of the bundle, as heating surfaces with the corresponding free cross sections over the entire area of the individual cells; consequently, the heating sheet bundle provides a higher thermal capacity. Simultaneously, the blockages in the passage cross sections of the individual cells are reduced, so that lower flow losses of the heat-exchanging media and a lower pressure drop can be achieved. Since the flow cross sections are not reduced in the case of the sandwich-type connection of the hollow box carrier, it is possible to construct the heating sheet bundle with pairs of profiled sheets on all sides if desired, i.e., in a circumferentially closed manner, and, thus, to provide an even greater stability.

In accordance with a further development of the present invention, one of the profiled sheets of the pair of profiled sheets is undulated and the other sheet is corrugated. Consequently, the pair of profiled sheets is always composed of one profiled sheet which is wave-shaped to a greater extent and one profiled sheet which is wave-shaped to a lesser extent; when several pairs of profiled sheets are provided at the sides of the bundle, the two types of profiled sheets are arranged on top of one another in a regular alternating manner.

In accordance with a preferred embodiment of the invention, the profiled sheets are connected to each other at welding spots. The two sheets of a pair of profiled sheets or the sheets of several pairs of profiled sheets can be connected to each other in accordance with the spot-welding method in an automatic manufacturing process to produce the dimensionally stable composite body in the form of a hollow box carrier so as to produce the support means surrounding the bundles; welding is carried out at those points where the sheets contact each other. This is because, for reasons of thermal technology and flow technology, the profilings of the undulated sheet extend obliquely relative to the profilings of the corrugated sheet. Spot-welding can be carried out as soon as the two profiled sheets are placed on top of each other; the profiled sheets may be manufactured, for example, in accordance with the method known from DE 41 22 949 A. Alternatively, instead of using spot-welding, the two or more profiled sheets can be connected to each other by means of screws or rivets.

In accordance with a preferred embodiment of the invention, the end faces of the horizontal rods are located on the same level as the end faces of the radial walls of the cells of the heating surface carrier. The great dimensional stability achieved by the sandwich-type construction forming the hollow box carrier makes it possible to arrange the horizontal rods of the heating sheet bundle on the same level as the cell walls at the upper and lower end faces of the heating surface carrier. Corresponding to the number (usually two) of the parallel horizontal rods, this results in an additional radial sealing contour and, consequently, in a lower media leakage. This is because not only each individual cell wall of the heating surface carrier provides a seal against the respective radial sealing plates, but also serving as seals are the support flat irons of the horizontal rods of the heating sheet bundles which extend parallel to the radial walls of the cells and are in aligned contact with the upper and lower edges of the heating surface carrier. Consequently, the horizontal rods increase the number of sealing lines per radial seal and cell of the heating surface carrier, so that the volumetric flow transferred in the area of these seals is reduced as a result of the pressure drop, which contributes to a leakage reduction.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 5 is a top view of a heating sheet bundle placed in a cell of the heating surface carrier of the regenerative heat exchanger;

FIG. 6 is a top view, on a larger scale, of the heating sheet bundle of FIG. 5; and FIG. 7 is a partial longitudinal sectional view of the heating surface carrier with the adjacent upper and lower radial seals of the revolving hoods or connecting ducts, not illustrated.

DESCRIPTION OF THE PREFERRED EMBODIMENT

Figure 1:
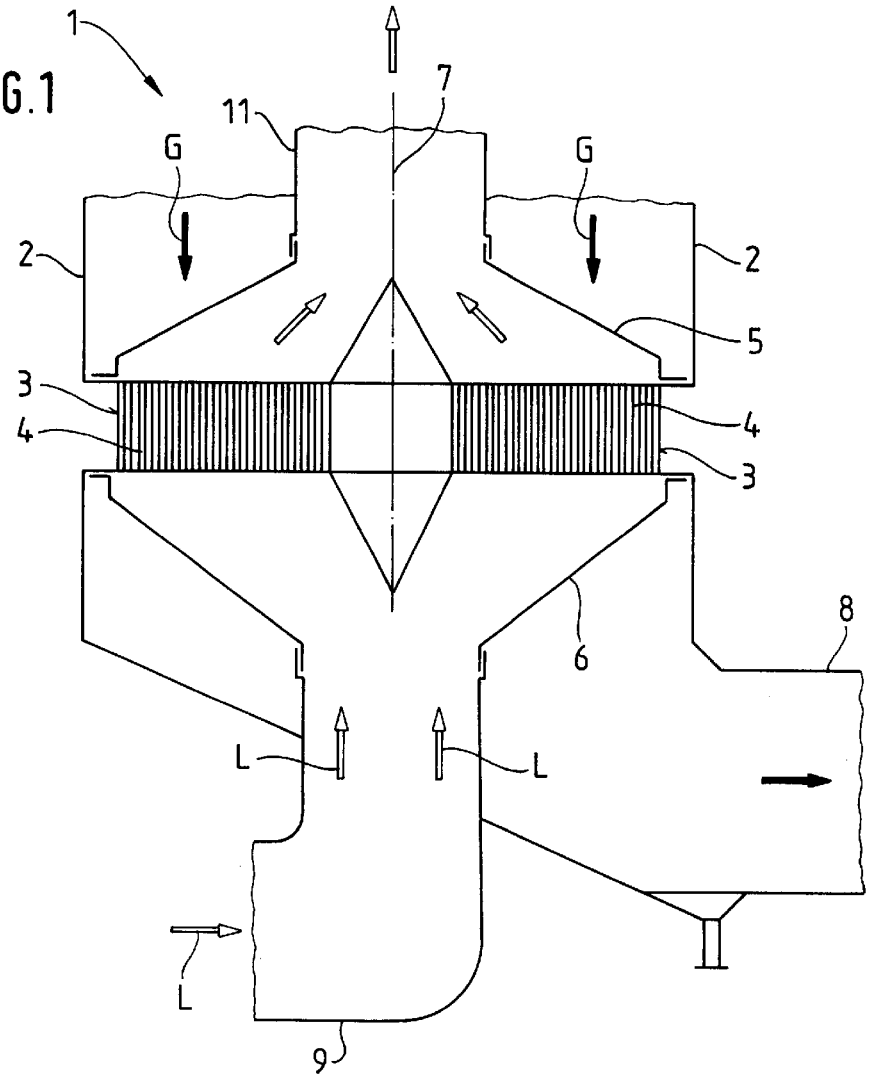
FIG. 1 is a schematic illustration of a regenerative heat exchanger with revolving hoods.
Figure 2:
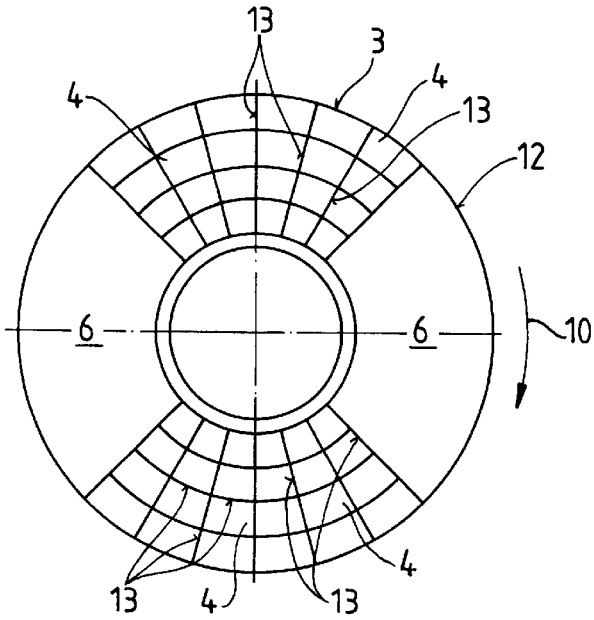
FIG. 2 is a cross sectional view of the regenerative heat exchanger shown in FIG. 1 taken in the plane of air entry, as seen from the direction of air entry.

FIG. 1 of the drawing shows a regenerative heat exchanger 1 constructed as an air preheater. Hot waste gas flows from a steam producer, not shown, into the regenerative heat exchanger 1 through a duct 2. The hot gas G flows from the top into the regenerative heat exchanger 1 which, in the illustrated embodiment, is provided in the middle portion thereof with a circular heating surface carrier 3 which has trapezoidally segmented cells 13 whose cross section increasingly becomes greater from the inside toward the outside, as can be seen in FIG. 2.

Figure 3:
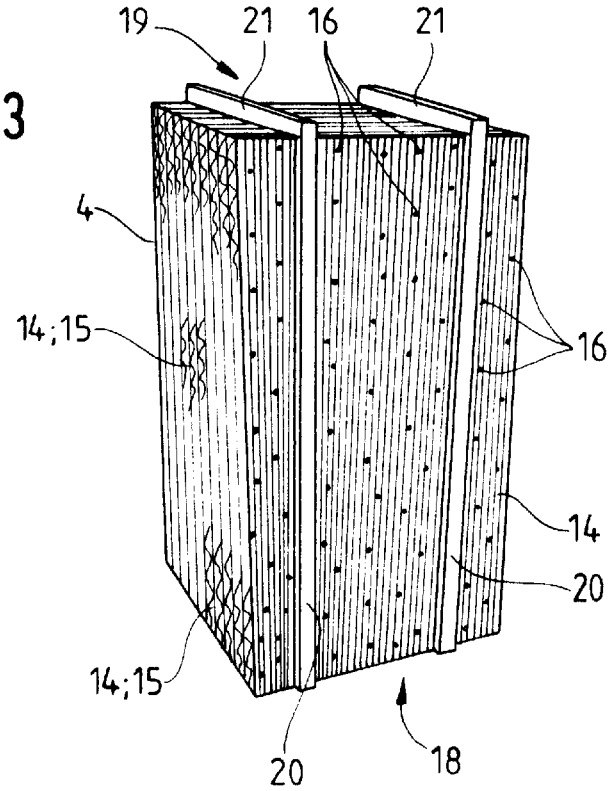
FIG. 3 is a perspective view, on a larger scale, of a heating sheet bundle used in the regenerative heat exchanger, wherein the two parallel end surfaces are at the outside provided with spot-welded profiled sheets.

The heating surface carrier 3 receives in the cells 13 storage masses in the form of heating sheet bundles 4 of the type shown in FIG. 3. A segmented hood 5, 6 each is provided on both sides of the heating surface carrier 3 or the heating sheet bundles 4. The hoods 5, 6 continuously revolve about a common vertical axis 7, wherein the revolving movement continuously causes different portions of the storage masses or heating sheet bundles to be subjected to the hot gas G. The hot gas G heats the large number of profiled sheets of the heating sheet bundles 4; the gas G is cooled in the process and leaves the regenerative heat exchanger 1 at the bottom end through the duct 8.

At the bottom end of the regenerative heat exchanger 1, a line 9 is connected to the hood 6. In a counter-current flow to the gas G, cold combustion air L flows to the heating sheet bundles 4 heated by the gas through the line 9 and through the hood 6 which revolves in the direction of rotation 10 shown in FIG. 2. The air L cools the profiled sheets of the heating sheet bundles 4 acting as storage masses while being heated and the heated air flows to the furnace through the upper hood 5 which revolves congruently with the hood 6, as shown in FIG. 1, and through a duct 11.

Figure 4:
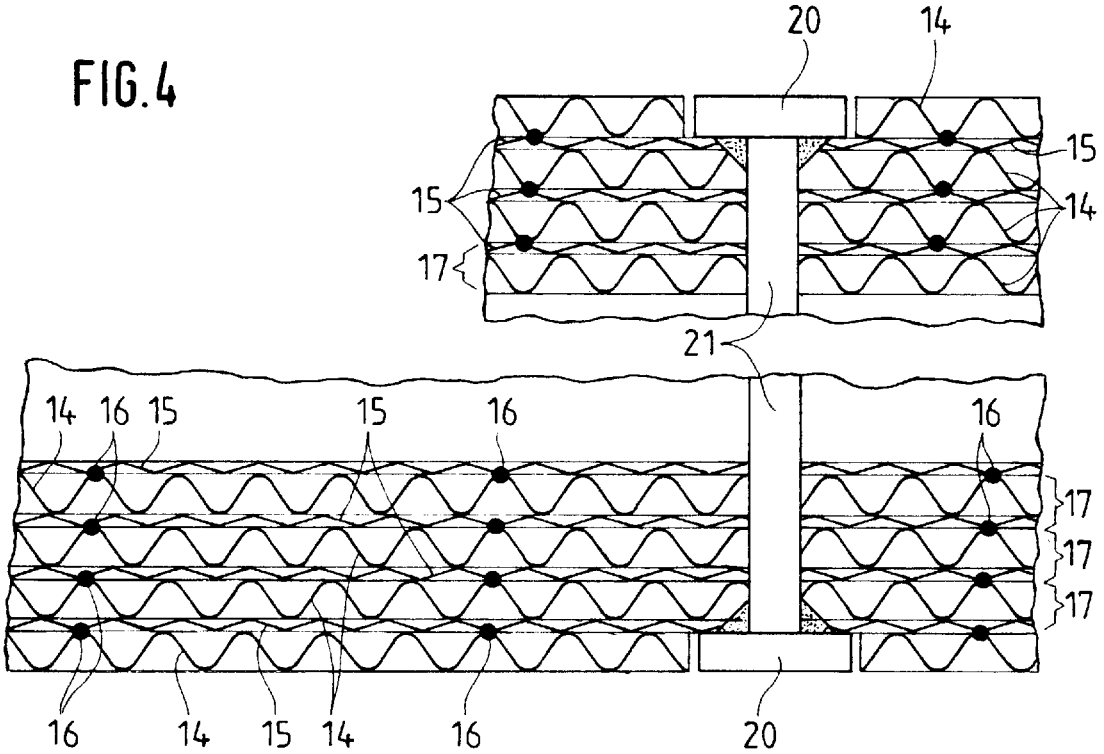
FIG. 4 is a sectional view, on a larger scale, showing the spot-welded profiled sheets at the end surfaces of the heating sheet bundle of FIG. 3.

The heating sheet bundles 4 adapted to the respective sizes of the trapezoidally shaped cells 13 are composed of a plurality of different profiled sheets 14, 15 which are placed against each other, as shown in FIG. 4. Of these profiled sheets, the profiled sheets 14 are undulated and have deeper rolled profiles, while the profiled sheets 15 are corrugated and the rolled profiles of the profiled sheets 15 are of smaller height. The profiled sheets 14 and 15 are arranged in an alternating manner and always two profiled sheets 14, 15 are connected to each other by welding spots 16 to form a pair 17 of profiled sheets; each pair 17 forms a dimensionally stable composite plate of a hollow box carrier; starting from the end sides, always only the corrugated sheet 15 is welded to the undulated sheet 14 to form a pair. As shown in more detail in FIGS. 4 and 6, several pairs 17 of profiled sheets are spot-welded together at each end of the heating sheet bundle 4, wherein this configuration can be varied as desired depending on the required stability.

The dimensional stability ensured by the welding spots 16 is completed by vertical outer rods 20 at the outer pairs 17 of profiled sheets, wherein the outer rods 20 are connected to horizontal rods 21 at the upper and lower sides of the bundle, as shown in FIG. 3, so that the heating sheet bundle 4 is circumferentially surrounded by two space-saving rod straps. Instead of the tangential mounting of the heating sheet bundle 4 shown in FIG. 5, the heating sheet bundle 4 can also be mounted with radially aligned profiled sheets 14, 15; in this case, the individual profiled sheets 14, 15 extend parallel to the radial walls 22 of the cells 13 of the heating surface carrier 3.

The extremely high dimensional stability of the heating sheet bundles 4 makes it possible that the outer end faces 23 of the upper and lower horizontal rods 21 can be located on the same level as the end faces 24 of the radial walls 22 of the cells 13, as is apparent from FIG. 7. Consequently, together with the radial seals 25 of the revolving hoods 5, 6, this increases the number of sealing lines per radial seal 25 and cell 13, i.e., the number of sealing lines is increased by the number of existing horizontal rods 21. The volumetric flow conducted in the areas of these seals as a result of the pressure drop, as indicated by arrows L for air and G for gas in FIG. 7, is decisively reduced by the multiple sealing means achieved as a result, which, in turn means that the leakage is reduced.

While specific embodiments of the invention have been shown and described in detail to illustrate the inventive principles, it will be understood that the invention may be embodied otherwise without departing from such principles.

We claim:

1. A heating sheet bundle adapted to be mounted tangentially or radially in trapezoidally segmented cells of a heating surface carrier of a regenerative heat exchanger with stationary or revolving storage masses, the heating sheet bundle comprising a plurality of profiled sheets mounted so as to be placed against each other and forming flow ducts therebetween, wherein at least two outer profiled sections on at least two oppositely located sides of the bundle are constructed as a pair of profiled sheets connected in a sandwich-like manner so as to be dimensionally stable, wherein one of the profiled sheets of the pair of profiled sheets is undulated and another of the profiled sheets of the pair of profiled sheets is corrugated, each sheet having a rolling depth, and wherein the rolling depth of the undulated sheet is greater than the rolling depth of the corrugated sheet.

2. The heating sheet bundle according to claim 1, comprising welding spots for connecting the profiled sheets.

3. The heating sheet bundle according to claim 1, comprising a horizontal rod each at an upper side of the bundle and at a bottom side of the bundle, the profiled sheets comprising vertical outer rods connected to the horizontal rods.

4. The heating sheet bundle according to claim 3, wherein end faces of the horizonal rods are located on an equal level with end faces of radial walls of the cells of the heating surface carrier.

* * * * *